United States Patent [19]

Cook

[11] Patent Number: 4,478,348

[45] Date of Patent: Oct. 23, 1984

[54] CHILD RESISTANT CONTAINERS

[75] Inventor: Norman Cook, Wirral, England

[73] Assignee: Lever Brothers Co., New York, N.Y.

[21] Appl. No.: 413,108

[22] Filed: Aug. 30, 1982

[30] Foreign Application Priority Data

Sep. 1, 1981 [GB] United Kingdom ..... 8126443

[51] Int. Cl.[3] ..... B65D 45/00

[52] U.S. Cl. ..... 220/318; 220/94 R; 229/52 AC

[58] Field of Search ..... 220/318, 94 R; 150/33; 229/52 AC; 292/258; 24/143 B; 206/8; 16/114 R

[56] References Cited

U.S. PATENT DOCUMENTS 3,893,725 7/1975 Coulter et al. ..... 220/318

4,067,493 1/1978 Stavin ..... 229/52 AC

*Primary Examiner*—George T. Hall

[57] ABSTRACT

A container suitable for carrying detergent liquids or powders provided with a lid. The container has a carrying strap which is adjustable between a carrying position and a securing position in which it is tensioned over the lid to secure it on the container in a child-resistant manner.

4 Claims, 2 Drawing Figures

CHILD RESISTANT CONTAINERS

This invention relates to containers suitable for liquids or solids and particularly to containers suitable for detergent liquids or powders.

It is now usual, particularly in the countries of continental Europe, for detergent powder to be sold in large containers. Such containers are heavy when full and consequently they are usually fitted with a plastics carrying strap or handle, each end of the strap being rivetted to the container.

There is also public concern about the hazard to young children of certain household products. For instance the hazard of strongly acid or alkaline products such as drain cleaners and descaling liquid products is widely appreciated and moves are in progress to encourage manufacturers to fit child-resistant closures to such products. (On the other hand it is less widely realised that certain alkaline powders, particularly powders for machine dishwashers can also be hazardous when eaten).

This invention relates to a combined carrying strap and child-resistant closure suitable for use on containers for liquids and solids.

Accordingly, the present invention provides a container suitable for a liquid or a solid provided with a lid and a carrying strap, the length of the carrying strap being adjustable between a carrying length and a securing length at which it is in tension over the lid or part thereof to secure the lid on the container.

In U.S. Pat. No. 4,067,493 a gift box or shoe box is shown which has a fixed carrying strap and in addition an elastic element stretchable over the lid to retain it on the box. We consider that such a box lacks the sophistication required both to be effective as a child-resistant container and to be useful on a day-to-day basis in a kitchen or similar environment, since it would be extremely difficult to remove a liquid or powder from it without spillage or without permanently damaging the elastic element.

The essential feature of the container of this invention is that it is provided with a carrying strap of adjustable length. One such type of strap which we have found to be useful is the type commonly used for tying bundles of cables together and normally referred to as a cable tie. Cable ties generally consist of an elongated strap portion formed with a continuous series of steps, ridges or rings on one or both sides. One end of the strap carries a locking device through which the other end can be pulled to form a loop. Some cable ties are designed so that the strap will pass through the locking device in one direction only, so that the loop can be tightened but not loosened, and this type of tie can only be removed from a bunch of cables for example by cutting. That type of tie is not useful in the containers of this invention. The type of tie which we have found useful is the type in which the locking device is releasable so that the length of strap can be altered in both directions.

It may be thought in some instances that a given cable tie is too narrow to be comfortable for use for carrying, say, a 5 Kg drum of detergent powder. In such a case it is a simple matter to arrange for a sleeve to be provided through which one end of the tie can be passed before it is attached to the container. Normally, however, it will be possible to use a cable tie of adequate width.

While the use of a cable tie for the containers of this invention is strongly preferred it is not essential. Other devices which have the same effect can be envisaged. For example a strap can be provided which has hinges in the appropriate positions to tension against the lid using an over-centre action. A second alternative which has been considered is a carrying strap formed with a series of holes, which is of such a length that it can be doubled back on itself so that two holes are aligned, and a plastics press-stud can be inserted through the holes to retain the strap either at the securing length or at the carrying length. Variations in the plastics material from which the press-stud is made can provide varying degrees of child resistance.

The invention will be further illustrated and described by reference to the accompanying drawing in which.

Figure 1:
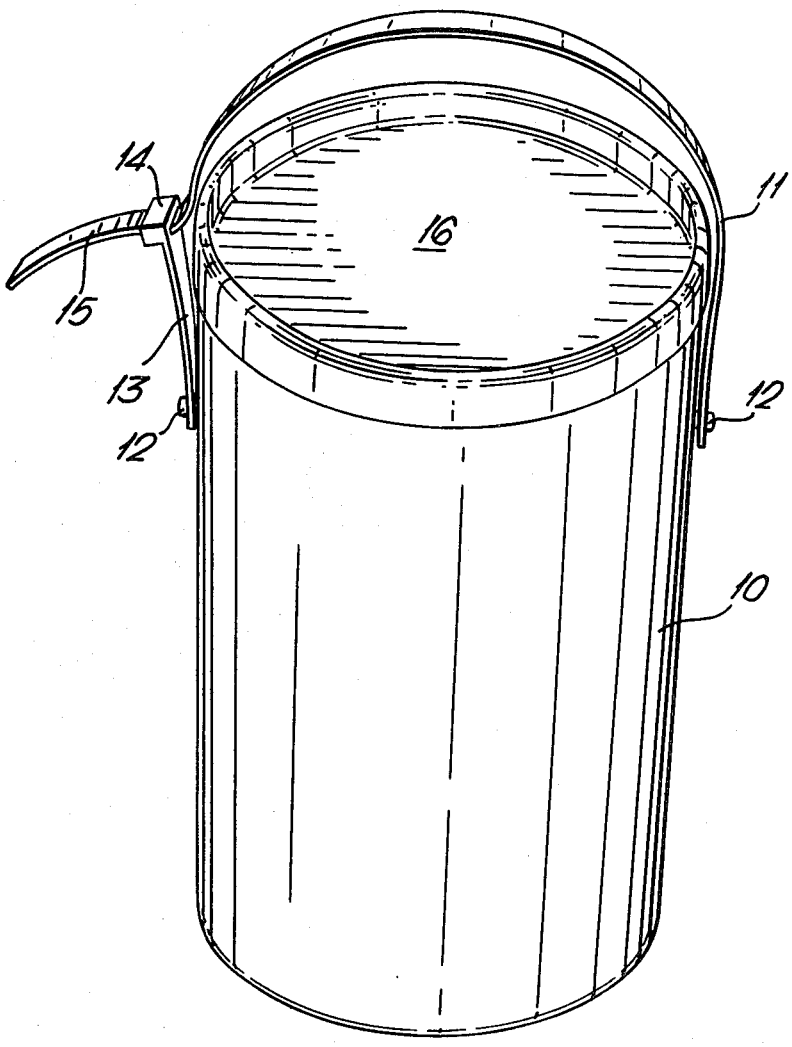
FIG. 1 is a perspective view of a container in accordance with the invention to which the carrying strap is shown in the carrying mode.

Referring first to FIG. 1, a cylindrical fibre board drum (10) is fitted with a carrying strap (11) using rivets (12). The carrying strap is in two parts, a first part (13) terminating in a releasable locking device (14) and a second part (15), the end of which is free and which is designed for insertion into the locking device (14) to form a complete strap. In FIG. 1 only a short length of the free end of the strap (15) has been pulled through the locking device (14). In this mode the strap is of a length suitable for use in carrying and the lid (16) is retained by friction only.

Figure 2:
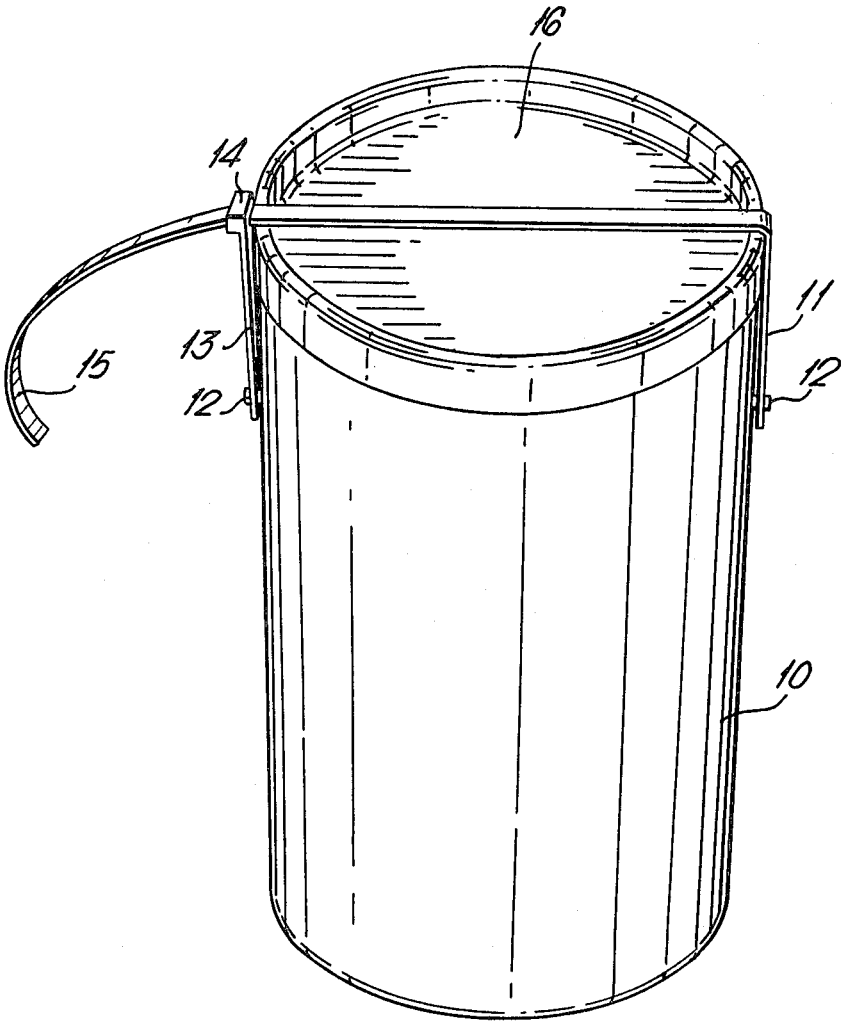
FIG. 2 is a perspective view of the container shown in FIG. 1, in which the carrying strap is shown in the securing mode.

Referring now to FIG. 2 the container shown is identical with that shown in FIG. 1. However, as shown the slack has been taken out of the carrying strap (11) by drawing the free end (15) through the locking device (15) so that the strap is in tension over the lid (16) to secure it on the drum.

We consider that the container shown in the drawings is extremely practical for holding and transporting large quantities of detergent powder, and with a suitable choice of releasable locking device that it can act as an effective child-resistant pack.

What is claimed is:

1. A container suitable for and containing detergent liquid or powder provided with a lid and a carrying strap, the length of the carrying strap being adjustable between a carrying length and a securing length at which it is in tension over the lid or part thereof to secure the lid on the container.

2. A container according to claim 1 wherein the length of the carrying strap is adjustable between the carrying length and the securing length by adjusting means resistant to adjustment by children.

3. A container according to claim 1 or claim 2 wherein the length of the strap is discontinuously adjustable between the carrying length and the securing length.

4. A container according to any one of the preceding claims wherein the strap is a cable tie.

* * * * *